US006668585B1

(12) United States Patent
Markowitz

(10) Patent No.: US 6,668,585 B1
(45) Date of Patent: Dec. 30, 2003

(54) MULTI-FACETED COMBINED CUT GEMSTONES

(76) Inventor: David Markowitz, 1313 53th St., Brooklyn, NY (US) 11219

( * ) Notice: Subject to any disclaimer, the term of this patent is extended or adjusted under 35 U.S.C. 154(b) by 0 days.

(21) Appl. No.: 09/711,686

(22) Filed: Nov. 13, 2000

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

D99,568 S * 5/1936 Cohn ..... D11/90
3,286,486 A * 11/1966 Huisman et al. ..... 63/32
3,585,764 A * 6/1971 Huisman ..... 451/58
4,118,950 A * 10/1978 Grossbard ..... 63/32
D348,024 S * 6/1994 D'Haene ..... D11/90
5,970,744 A * 10/1999 Greeff ..... 63/32
D419,103 S * 1/2000 Freilich ..... D11/90
D439,542 S * 3/2001 Turner et al. ..... D11/90
D442,114 S * 5/2001 Greeff ..... D11/90

* cited by examiner

*Primary Examiner*—J. J. Swann
*Assistant Examiner*—Andrea Chop

(57) ABSTRACT

The multi-faceted combined cut gemstone has the most facets in the history of gemstones. The King David cut with 104 facets makes the most brilliant, sparkling and eye-pleasing gemstone at the time it was developed. The Queen Batt-Sheva cut with 128 facets makes an even more brilliant; sparkling and eye-pleasing gemstones. Both of these gemstones have square tops and round bottoms. This combination makes them most fiery and sparkling cut in the world.

2 Claims, 9 Drawing Sheets

MULTI-FACETED COMBINED CUT GEMSTONES

BRIEF DESCRIPTION OF THE INVENTION

The present invention relates to a Multi-Faceted Combined Gem Stone. With a square top and round bottom. The Multi-Faceted Gem Stones have various characteristics that distinguish them from other gemstones.

Generally gem stone cutters try to achieve a good combination of brilliance and deception. The basic steps for a gemstone that is known to diamond cutters is blocking, including all shapes.

Blocking the round stone: step 1—you are cutting four top corners and four Basils at the top. In four corners at the bottoms in four pavilions. Then we make the brilliand daring facets at the top and bottom totaling 56 facets.

Emerald Cut is blocked with 3 step cuts at the top corners parallel with the table and the girdles, and 3 step cuts at the point. At the bottom corners also 3 step cuts and the same at the points, 3 facets from the girdle break up to the Culet. Totaling 48 facets. And so further all the shapes the marquise the pear shape the radiant and the luceda, are faceted about 48 to 56 facets.

As known for generations for diamond cutters to make a brilliant really alive fire and sparkling is what more calculated facets cuts one varies the other. And that is what I created.

The King David cut with its 104 brilliant cuts makes it the most brilliand and sparkling diamond gem stone ever manufactured.

The Queen Bat-Sheva Cut with its 128 brilliant cuts makes the gem-stone much more flammable fire; much more sunshine with its most brilliant facets.

It is an object of the present invention to provide a multi-faceted cut having more dispersion than a step cut or emerald cut gemstone.

It is an object of the preset invention to provide a multi-faceted cut gemstone having a substantially square shaped and round bottom which is elegant and classic.

It is an object of the preset invention to provide a multi-faceted gemstone having a brilliant cut which provides good dispersion.

It is an object of the present invention to provide a multi-faceted gemstone having the combination of the elegance and classic appeal of a multi-faceted with the good dispersion of a brilliant cut.

It is an object of the present invention to provide a multi-faceted gemstone, which provides a good balance of very good brilliance, dispersion and scintillation.

It is an object of the present invention to provide a multi-faceted gemstone which provides good brilliance, dispersion and scintillation with the multi-faceted brilliance It is an object to the present invention to provide a multi-faceted gemstone, having substantially symmetry.

It is an object to present invention to provide a multi-faceted gemstone having a table with a table percentage providing a good balance of brilliance dispersion and scintillation It is an object of the invention to provide a multi-faceted gemstone having essentially one culet centrally located at the base of the pavilion which is a point.

It is an object of the invention to provide a multi-faceted gemstone having a table with a table size that is not too small as to lose brilliance, yet not too large as to lose dispersion.

Other object and advantage of the present invention will become more apparent from the detailed description of the preferred, embodiment appended claims and attached drawings.

DETAILED DESCRIPTION OF THE PREFERRED EMBODIMENT

Figure 1:
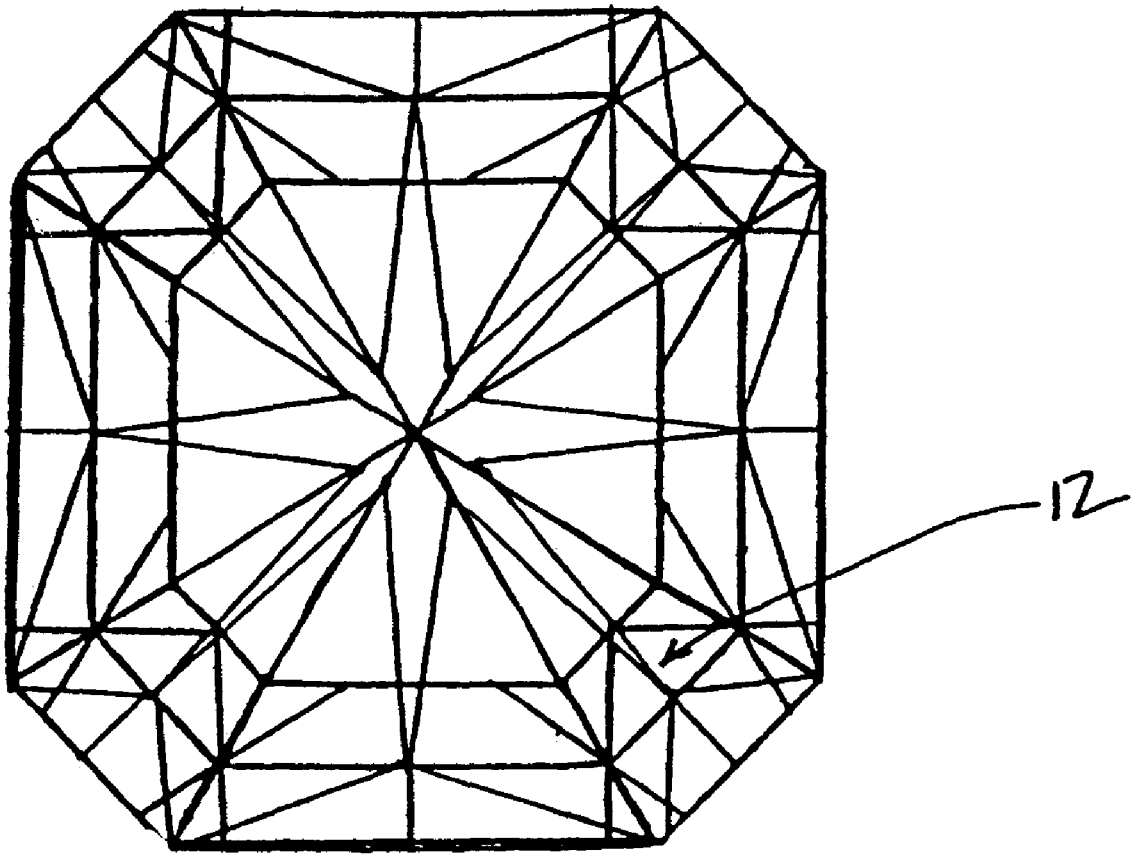
FIG. 1: King David cut with its multi facets top and bottoms. All the 104 brilliant facets not including the culet points and the girdle cuts.
Figure 2:
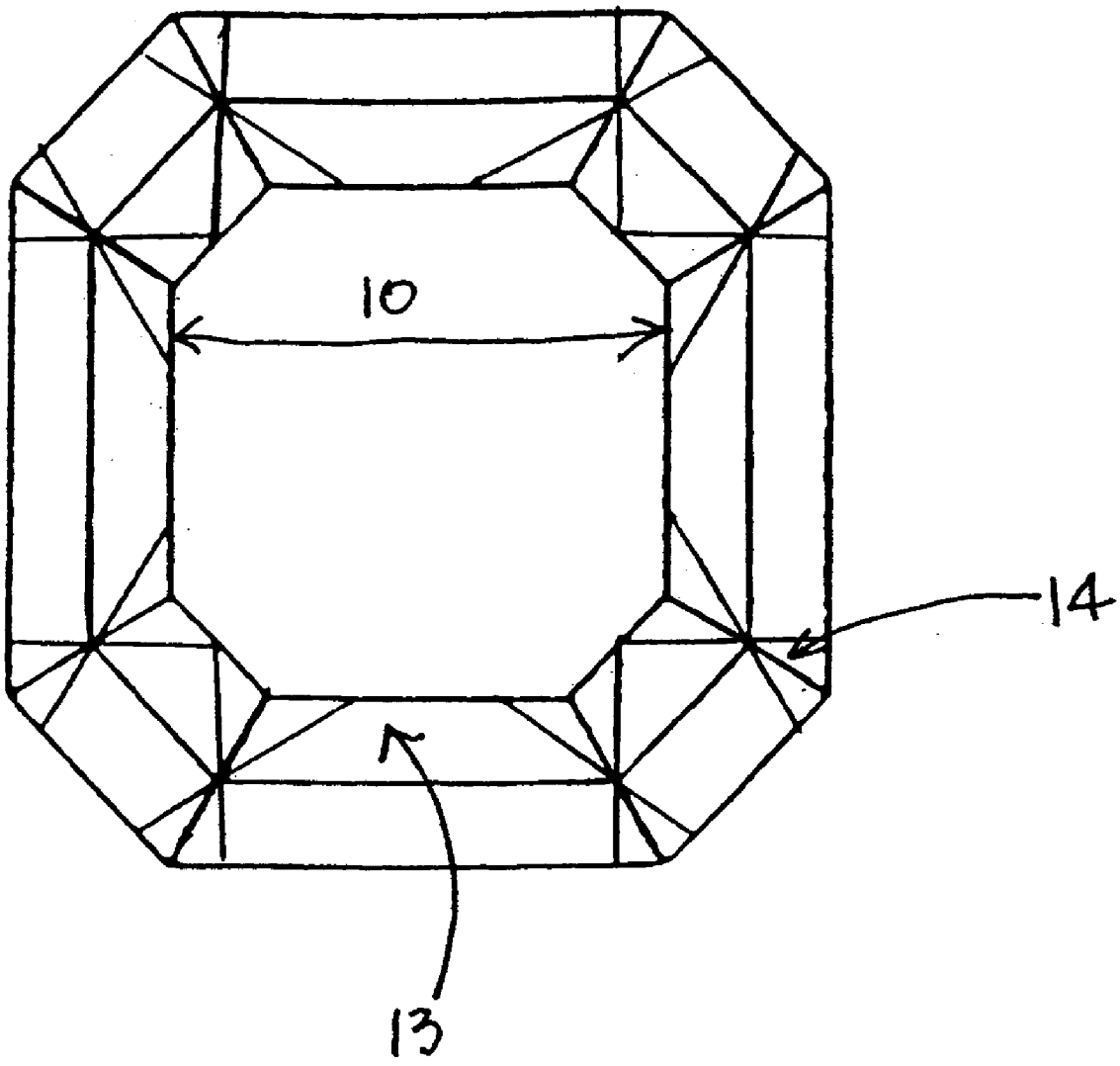
FIG. 2: Shows the 4 two faceted top corners and the 4 two faceted points plus the brilliantdaring facets to taling 48 facets.
Figure 3:
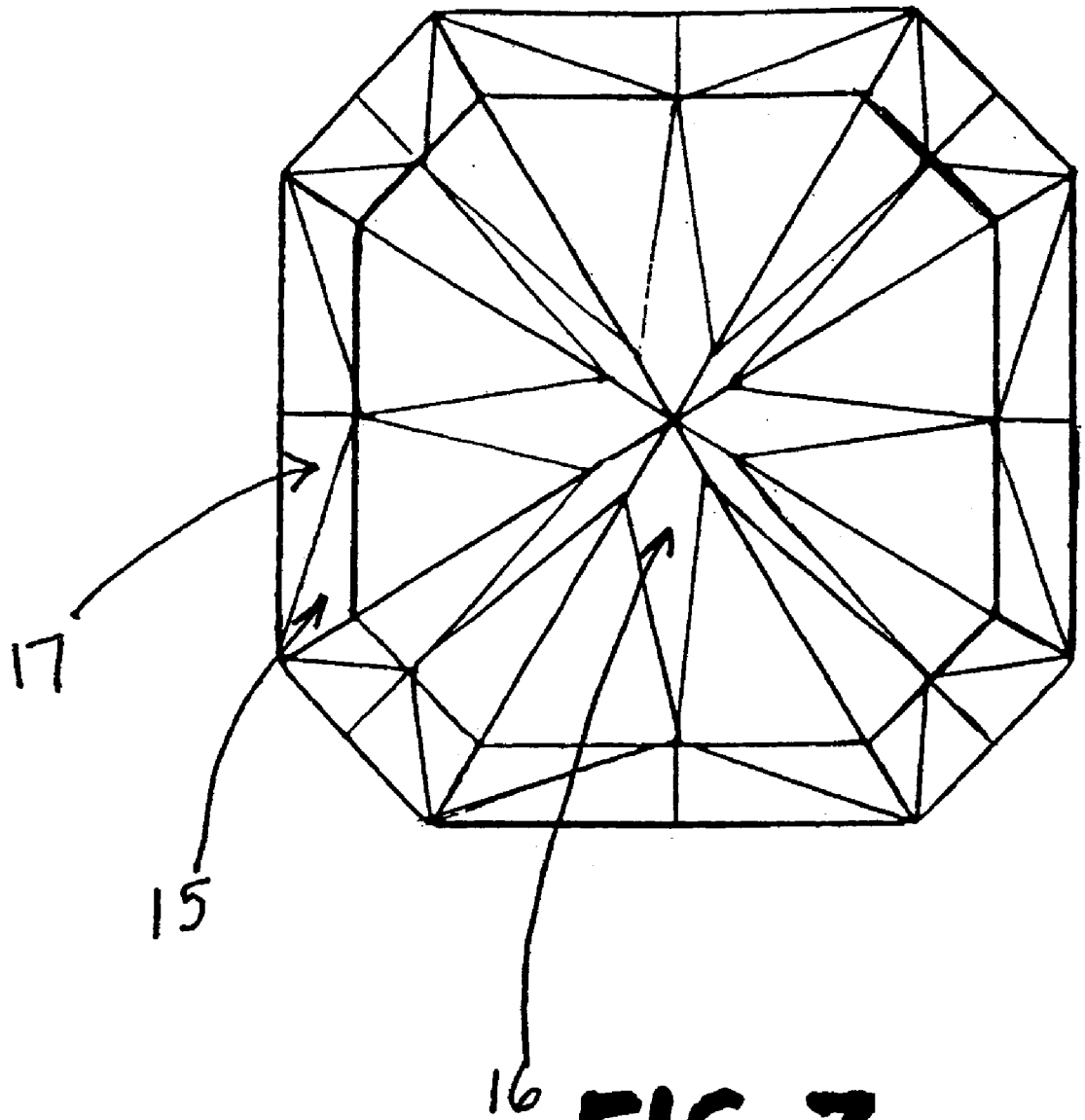
FIG. 3: Shows the bottom. 4 bottom corers from the girdle to the culeto and 4 points from the girdle to the culet and the brilliant daring facets totaling 56 facets.
Figure 4:
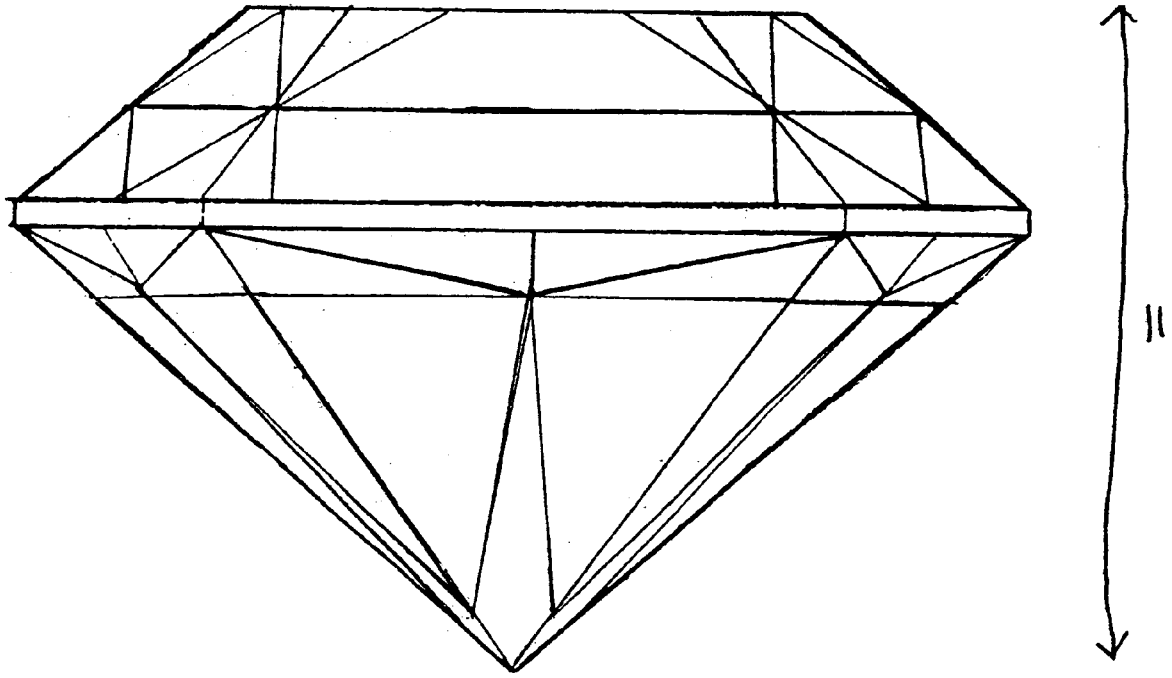
FIG. 4: Shows a side view with the girdle and the points at top and bottom and the brilliantdaring.
Figure 5:
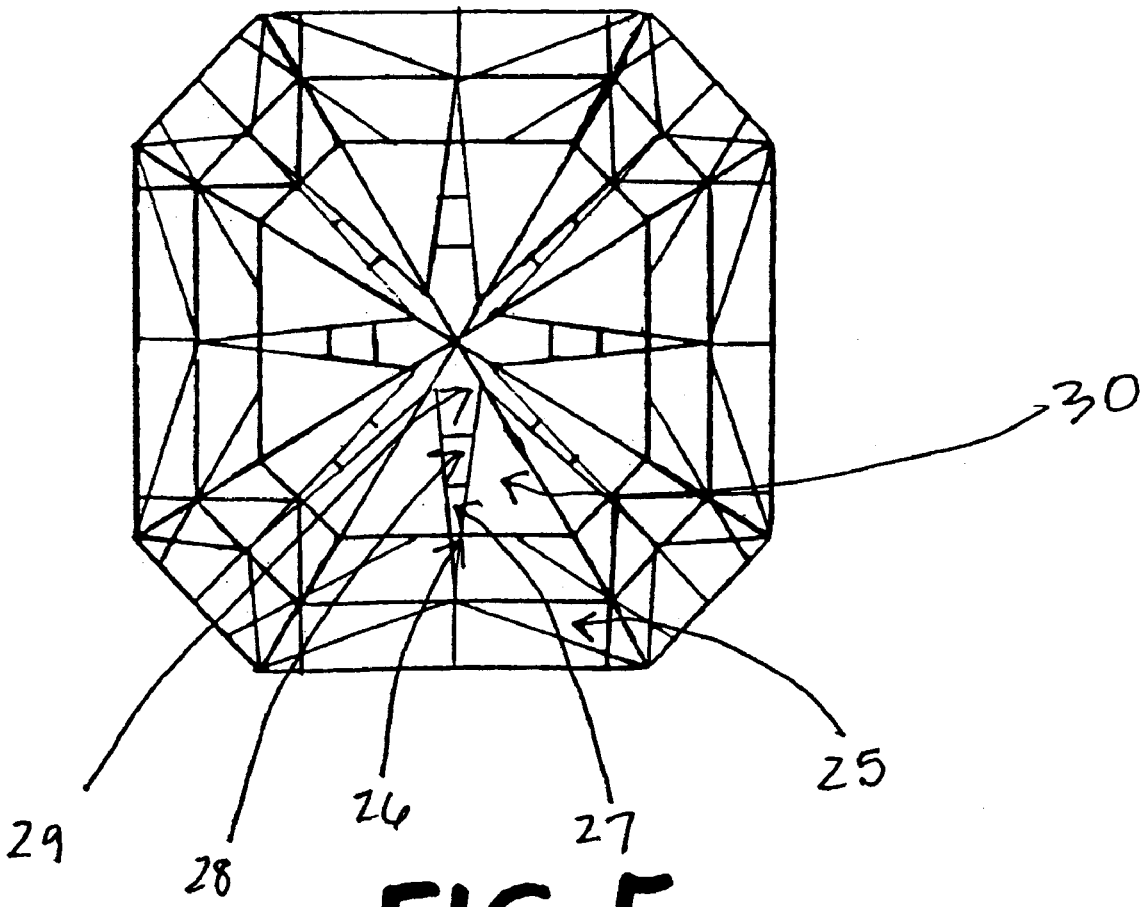
FIG. 5: Shows the Queen Bat-Sheva. A view of the top and bottom. The blocking and brilliantdaring with a total of 128 facets shown through the table.
Figure 6:
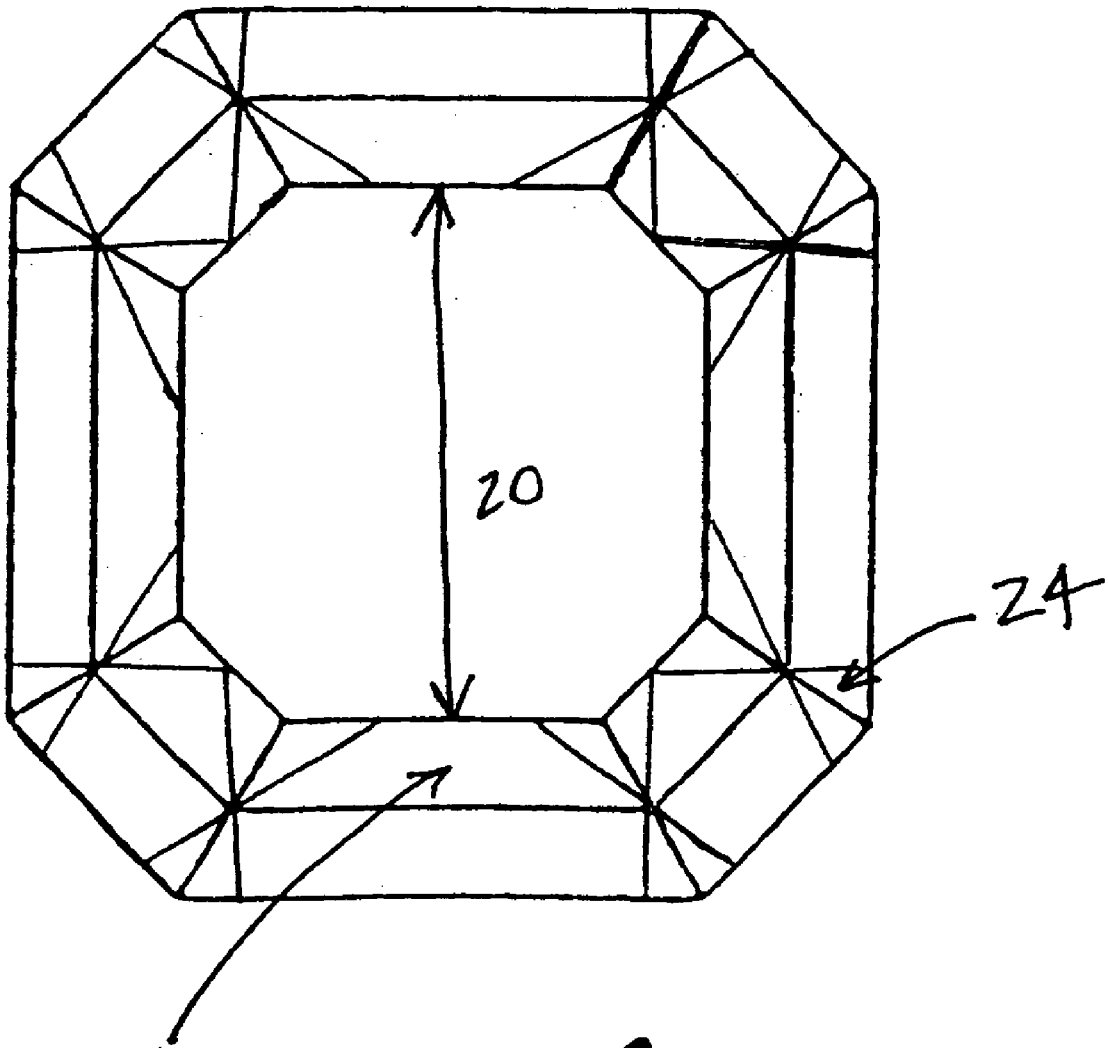
FIG. 6: Shows the 4 two faceted top corners and the 4 two faceted points plus the brilliantdaring facets to taling 48 facets.
Figure 7:
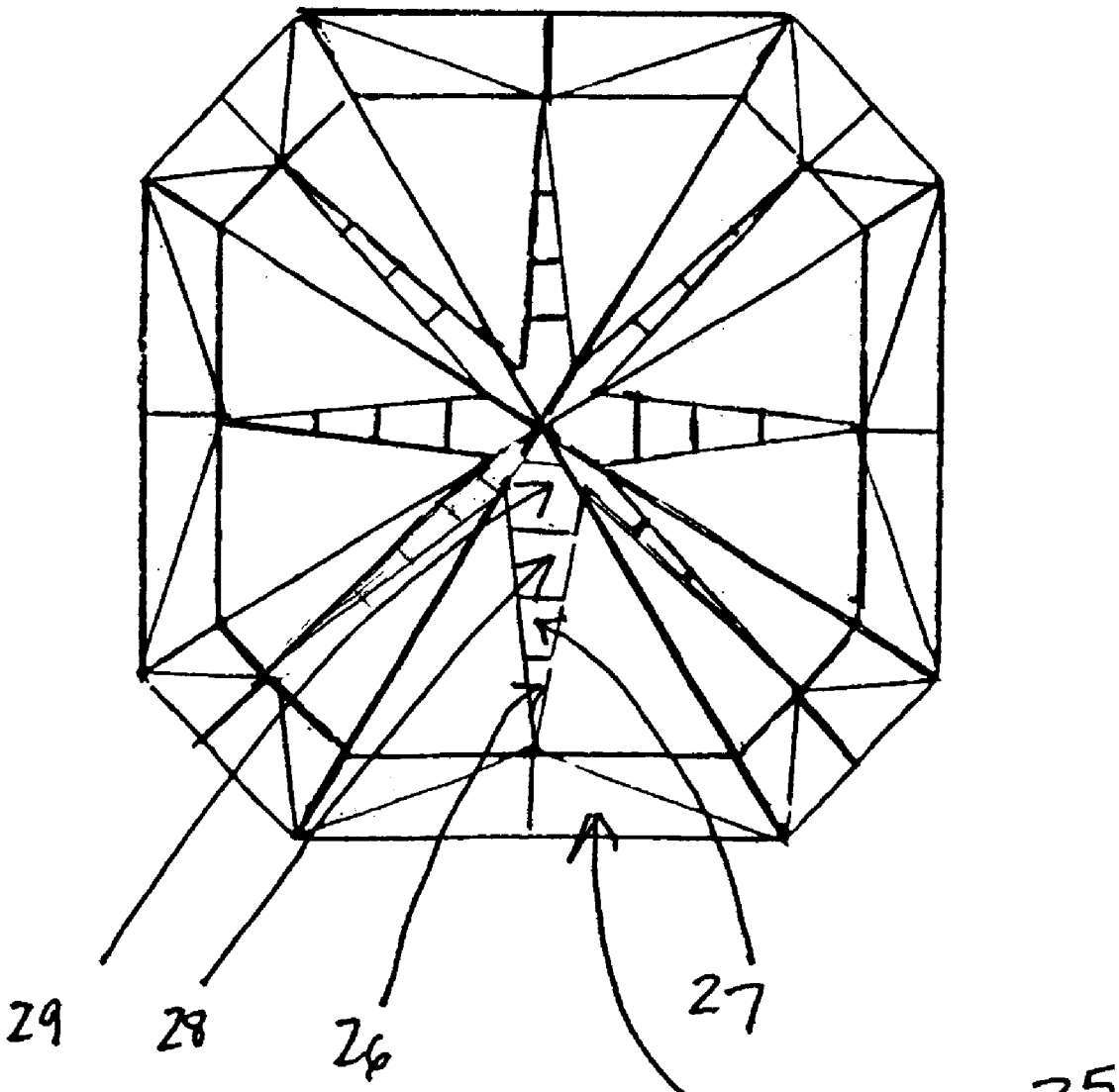
FIG. 7: Shows the bottom with it's 80 facet cuts, that makes it the most lively, full of fire gem stone ever made.
Figure 8:
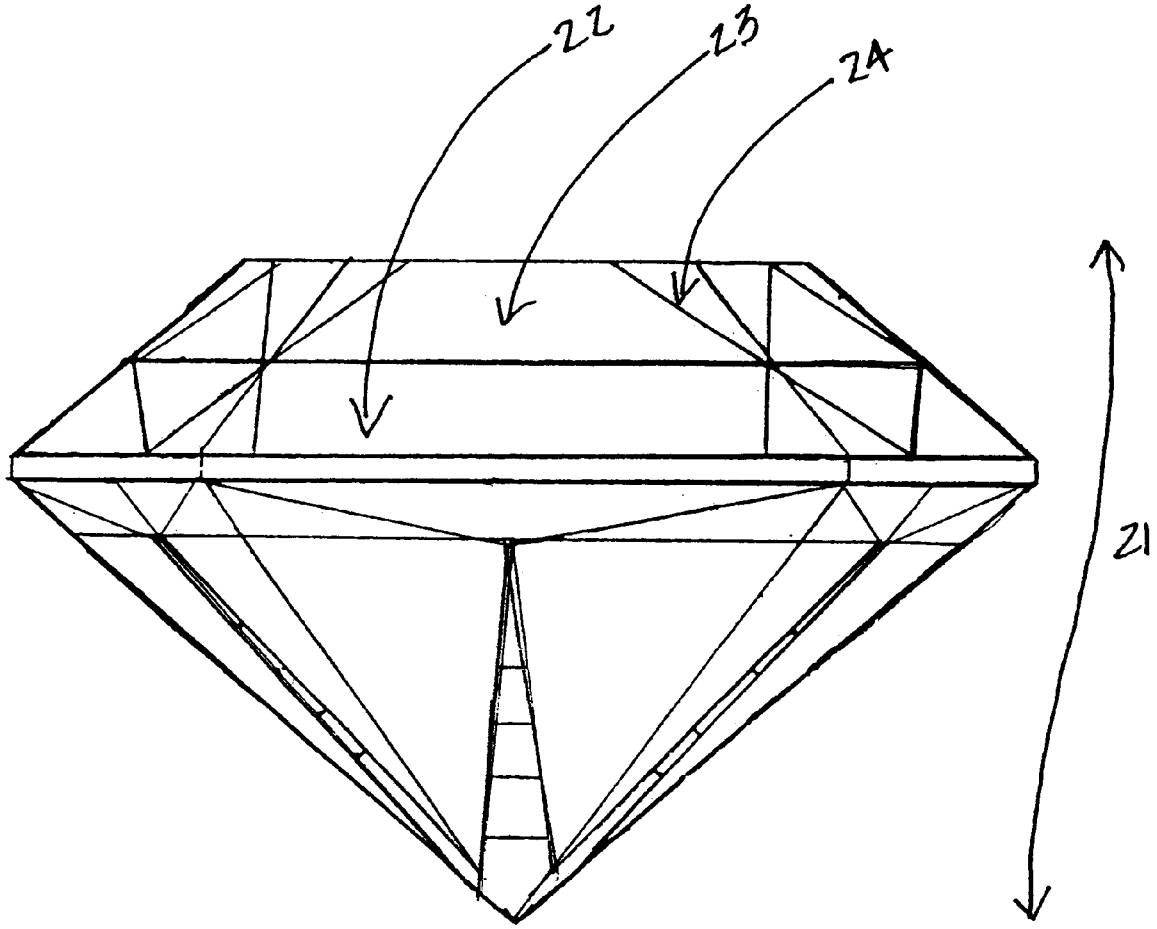
FIG. 8: Shows a side view with the girdle and the points at top and bottom and the brilliantdaring.
Figure 9:
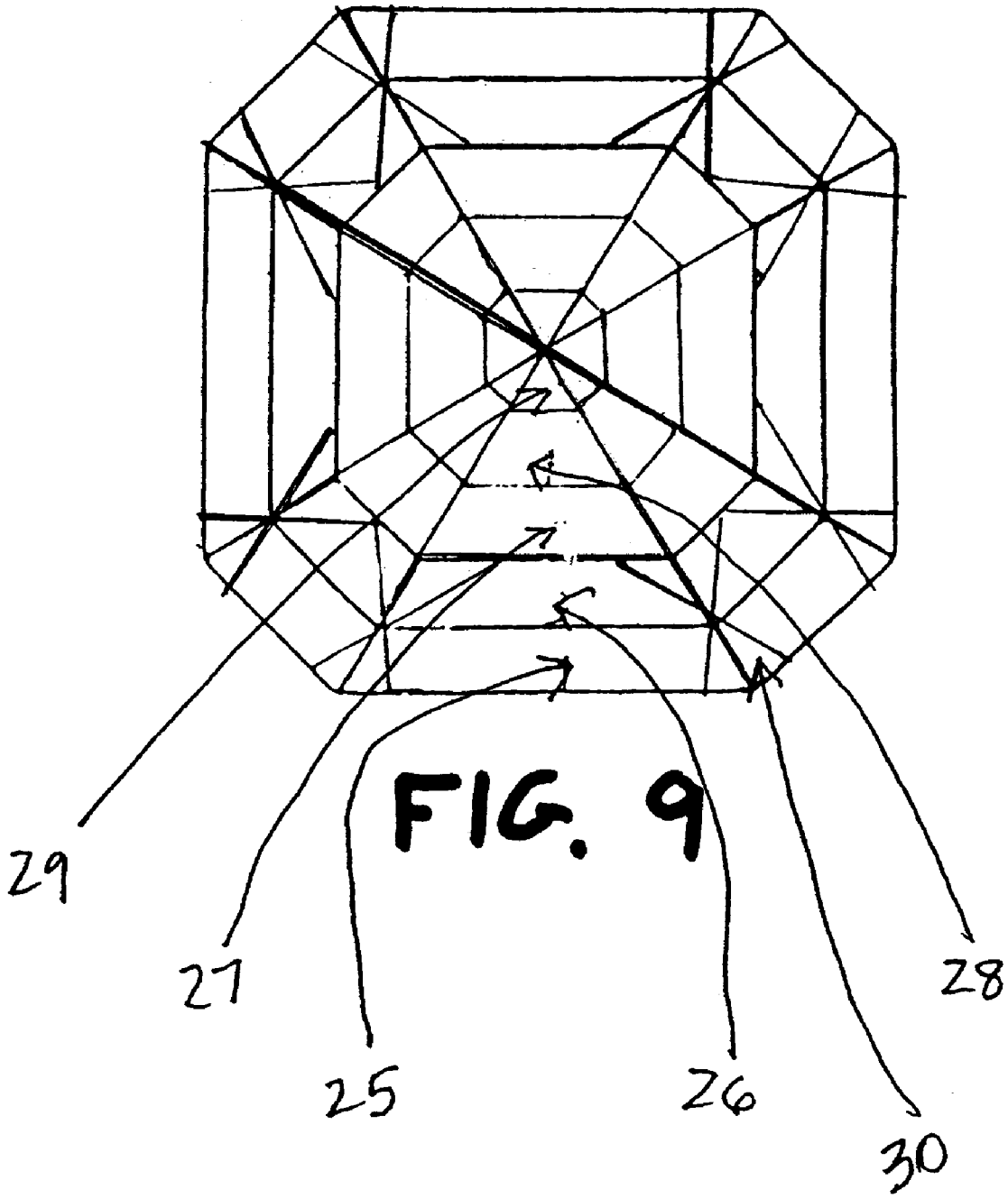
FIG. 9: Shows the Queen Bat-Sheva before the brilliantdaring. When it's blocked the bottom with 5 steps cuts and after brilliandaring is FIG. 7.

The current invention is a multi-faceted square gemstone comprising a crown, a pavilion, a culet and a girdle. The girdle has eight cuts. The crown is comprised of two faceted corners and two faceted points. The pavilion has four bottom corners from the girdle to the culet, and four points from the girdle to the culet. The pavilion has a total of 56 facets, while the entire gemstone has a total of 104 facets.

The length of the table (10) is 58–59 on all eight sides, creating a gemstone with the most unique and proportional square point. The depth (11) is 60–73 depending on the shape of the particular stone. The girdle break (12) from the top corner is 16–36 degrees. The table break corner (13) is 18–32 degrees. The brillianteering (14) on the girdle break is 18–38 degrees.

The bottom corners consist of a girdle corner (15), which break at 50–70 degrees, and the second culet break (16) is 41–44 degrees. The brillianteering (17) on the corners and pavilion are 55–65 degrees, depending on the thickness of the girdle.

The invention also includes another multi-faceted square gemstone comprising a crown, a pavilion, a culet and a girdle. The girdle has eight cuts. The crown is comprised of two faceted corners and two faceted points. The pavilion has four bottom corners from the girdle to the culet, and four points from the girdle to the culet. The pavilion has a total of 80 facets, while the entire gemstone has a total of 128 facets.

Again, the length of the table (20) is 58–59 on all eight sides, creating a gemstone with the most unique and proportional square point. The depth (21) is 60–73 depending on the shape of the particular stone. The girdle break (22)

from the top corner is 16–36 degrees. The table break corner (23) is 18–32 degrees. The brillianteering (24) on the girdle break is 18–38 degrees.

The bottom corners are cut in five different degrees, to achieve a more brilliant, sparkling fire in the gemstone. The five different degrees of the cut results in significant savings of 65% of the rough stone over the average cut stone.

The first cut (25) from the girdle upwards is at an angle of 50–70 degrees. The second cut (26) is at an angle of 42–50 degrees. The third cut (27) is at an angle of 42–46 degrees. The fourth cut (28) is at an angle of 40–43 degrees. The fifth cut (29) is at an angle of 41 degrees, and the brillianteering (30) of the bottom in the pavilion is at an angle of 40–50 degrees, and in some instances, depending on the height of the stone, the cut could go as high as 60 degrees. The multi-faceted gemstone cut in various degrees, produces an extremely unique diamond that sparkles with lively fire and shines with brilliant flashes.

What is claimed is:

1. A multi-faceted square gemstone comprising a crown, a pavilion, a culet, and a girdle, the girdle having eight cuts, the crown having being formed of two faceted corners and two faceted points, the pavilion having four bottom corners from the girdle to the culet, and four points from the girdle to the culet, the pavilion having 56 total facets, the gemstone having a total of 104 facets.

2. A multi-faceted square gemstone comprising a crown, a pavilion, a culet, and a girdle, the girdle having eight cuts, the crown having being formed of two faceted corners and two faceted points, the pavilion having four bottom corners from the girdle to the culet, and four points from the girdle to the culet, the pavilion having 80 total facets, the gemstone having a total of 128 facets.

* * * * *